United States Patent [19]

Arcadi, Jr.

[11] 4,376,486

[45] Mar. 15, 1983

[54] SHOE LAST RACK

[76] Inventor: Paul J. Arcadi, Jr., 1355 45th St., Sarasota, Fla. 33580

[21] Appl. No.: 226,747

[22] Filed: Jan. 21, 1981

[51] Int. Cl.[3] ..... A47F 7/08

[52] U.S. Cl. ..... 211/35; 211/87

[58] Field of Search ..... 211/34, 87, 60 T, 35, 211/37; 12/1 A, 122; 248/314

[56] References Cited

U.S. PATENT DOCUMENTS

| | | | |
|---|---|---|---|
| 819,777 | 5/1906 | MacDonald | 211/34 |
| 835,121 | 11/1906 | Taylor | 211/35 |
| 1,270,817 | 7/1918 | Hammond | 211/34 |
| 1,977,512 | 10/1934 | Hills | 211/35 |
| 2,662,719 | 12/1953 | Hammond | 248/314 |
| 2,729,341 | 1/1956 | Freeman | 211/37 |
| 2,989,188 | 6/1961 | Auer et al. | 211/37 |

*Primary Examiner*—William H. Schultz
*Assistant Examiner*—Ramon O. Ramirez
*Attorney, Agent, or Firm*—Hauke and Patalidis

[57] ABSTRACT

A shoe lasts rack comprises a support member to which are fixed outwardly projecting loops of different sizes to accommodate shoe lasts of different sizes, and associated with each loop is a pin that is outwardly projecting from the supporting member and on which the shoe last rests when placed in the rack.

5 Claims, 3 Drawing Figures

SHOE LAST RACK

BACKGROUND OF THE INVENTION

This invention relates to repairing of shoes, and more particularly to a device in aid of repairing of shoes.

In the art of repairing shoes, it is necessary from time to time, and sometimes very frequently, for a shoe repairman to change the shoe repair last to suit a particular shoe or pair of shoes on which the shoe repairman works. It is well known that a shoe last for men's shoes is larger than a shoe last for women's shoes, and that both are larger than a shoe last for children's shoes.

When the shoe repairman works on different types of shoes, he must change the last to suit the type of shoe he is repairing. On a shoe repairman's bench there are many things and tools he uses in his trade such as leather, nails, adhesive, hammers and the various lasts for the shoes he works on.

A shoe repairman may have as many as six different shoe repair lasts on his work bench at any one time and the lasts take up considerable space that could be utilized for other things. The shoe repair lasts could be stowed in a box or some other place near the work bench, but it is inconvenient and time consuming to hunt for a particular last when needed.

The present invention provides a shoe last rack that can be conveniently attached to a shoe repairman's bench and that holds the several different sizes shoe repair lasts in a location from which they can be easily and quickly removed as needed and to which they can be readily returned.

SUMMARY OF THE INVENTION

A rack for holding shoe repair lasts in accordance with the invention comprises a plurality of loops of various sizes extending outwardly from a planar supporting member on which are fixed a plurality of outward extending pins that are associated with respective loops. For a further understanding of the invention, reference may be made to the drawing and to the description of one embodiment of the invention in which features and advantages of it are set forth.

DETAILED DESCRIPTION

Figure 1:
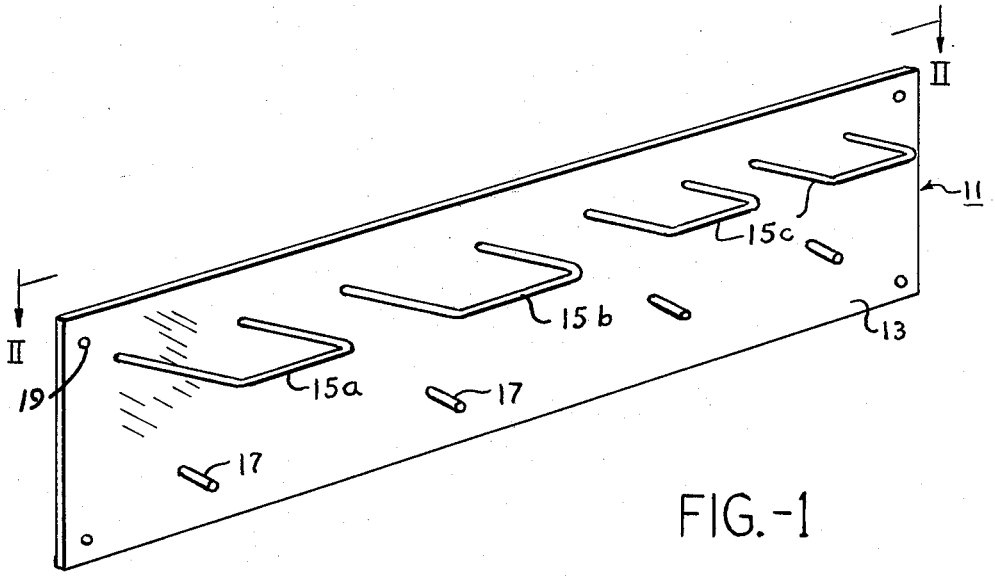
FIG. 1 is a schematic view of a shoe repair last rack in accordance with one embodiment of the invention.

Referring to FIG. 1, a shoe repair lasts rack 11, in accordance with the invention, includes a planar supporting member 13 that may be made of metal or any other suitable material. Spaced apart at convenient intervals are a plurality of U-shaped loops 15 that are fixed to and extend outward generally normal to the supporting surface 13. The several U-shaped loops 15 are of different sizes; loop **15*a* being large enough to hold a man's shoe repair last; loop 15*b* being large enough to hold a woman's repair shoe last; and loops 15*c*** being large enough to hold children's shoe lasts.

Figure 2:
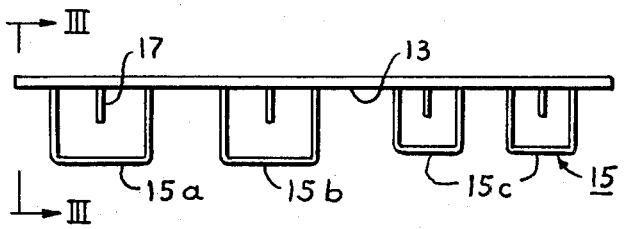
FIG. 2 is a view along line II—II of FIG. 1.

Beneath each respective loop is a pin 17, fixedly mounted to the supporting member 13. Each pin 17 projects outwardly and downwardly slightly and is centered with respect to a respective loop 15, as shown in FIGS. 2 and 3.

At convenient locations on the supporting member 13, there are holes 19 through which suitable fastener screws 21 or the like may be inserted to secure the rack 11 to the side of a shoe repairman's bench 23.

Figure 3:
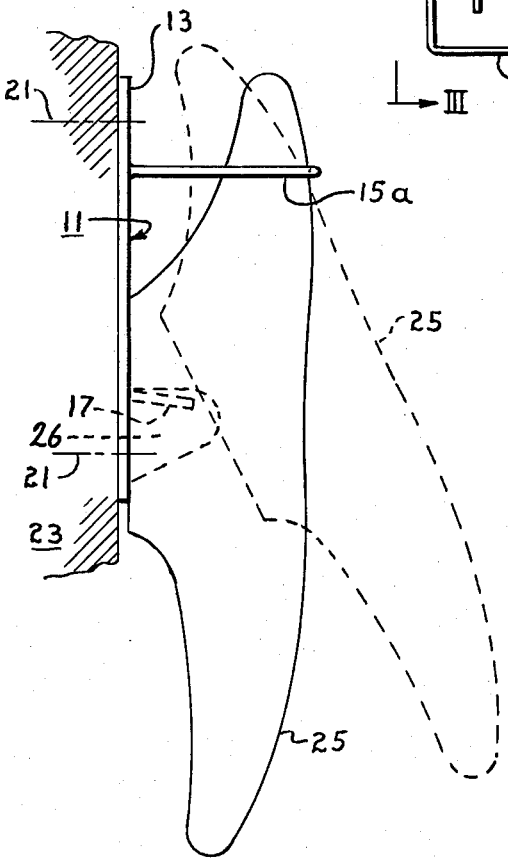
FIG. 3 is a view along line III—III of FIG. 2.

Referring to FIG. 3, there is shown a typical shoe repair last 25 having a conventional socket 26 therein in the stowed position in the rack 11 where it is supported by a pin 17 and a loop 15. In dotted outline, the shoe repair last 25 is shown being inserted in the typical loop **15*a***.

From the foregoing description of one embodiment of the invention, those skilled in the art will recognize many features and advantages among which the following are particularly significant:

That the shoe repairman's last rack is simple to construct and is easily attachable to a shoe repairman's bench so that shoe repair lasts will be ready for use when needed;

That the shoe repair last rack holds lasts of various sizes to suit the types of shoes on which the shoe repairman works altogether in one location;

That the lasts are quickly and easily placed in the rack and removed therefrom; and That the rack is inexpensive, yet thoroughly effective in holding heavy shoe lasts.

Although one embodiment of the invention shown and described herein has been specified with a certain degree of particularity, it is understood that the scope of the invention is defined by what is hereafter claimed.

What is claimed is:

1. A rack for holding shoe repair lasts used by a shoe repairman, said shoe repair lasts having each a socket and said rack comprising:

(a) a planar supporting member adapted for attachment to a shoe repairman's work bench in a substantially vertical position;

(b) a plurality of loop members each extending outwardly and substantially horizontally from a surface of said planar supporting member and affixed to said planar supporting member;

(c) a plurality of pins affixed to and projecting from said surface of the planar supporting member, each one of said pins being disposed at a downwardly directed slant angle below a corresponding one of said loop members in such a location that said socket in said shoe repair last engages over the pin and the loop member associated therewith peripherally engages said shoe repair last, whereby said last is supported by said co-operating pin and loop member in a substantially vertical position on said rack and in engagement with said surface.

2. The invention of claim 1 wherein:

(a) said loops are sized to accommodate shoe repair lasts of different sizes.

3. The invention of claim 1 including:

(a) means for supporting said rack to a shoe repairman's bench or the like.

4. A rack for vertically supporting shoe repairman's lasts each comprising a socket disposed in a portion of said last, said rack consisting of:

(a) a planar supporting surface;

(b) means holding said planar supporting surface in a substantially vertical position; and (c) at least one row of a plurality of last engaging and supporting members mounted to and projecting from said planar supporting surface; wherein each of said last engaging and supporting members mounted to said planar vertical supporting surface consists of an elongated member and a substantially horizontally disposed U-shaped member associated with and disposed above said elongated member in such a way that a last is held in a vertical position in engagement with said planar supporting surface when placed through said U-shaped member with said elongated member introduced in said socket.

5. The invention of claim 4 wherein:

(a) said elongated member introduced in said socket in said last is a pin projecting at a downward slant; and (b) each of said U-shaped members is of a size different from the size of the other U-shaped members, whereby each of said last engaging and supporting members is capable of engaging and supporting only a last of specific size.

* * * * *